US007730620B1

(12) United States Patent
Anastasi

(10) Patent No.: US 7,730,620 B1
(45) Date of Patent: Jun. 8, 2010

(54) PLASTIC PACKAGE OPENER

(76) Inventor: Christopher Anastasi, 16 Tumbleweed St., Trabuco Canyon, CA (US) 92679

( * ) Notice: Subject to any disclaimer, the term of this patent is extended or adjusted under 35 U.S.C. 154(b) by 0 days.

(21) Appl. No.: 11/466,594

(22) Filed: Aug. 23, 2006

Related U.S. Application Data

(60) Provisional application No. 60/710,623, filed on Aug. 23, 2005.

(51) Int. Cl.
*B26B 3/00* (2006.01)

(52) U.S. Cl. ..... 30/294; 30/2; 30/124; 30/280; 30/278

(58) Field of Classification Search ..... 30/294, 30/124, 2, 280, 278; 128/354, 303, 318, 128/305
See application file for complete search history.

(56) References Cited

U.S. PATENT DOCUMENTS

| | | | | | |
|---|---|---|---|---|---|
| 1,082,400 | A | * | 12/1913 | Burnite | 30/289 |
| 2,238,753 | A | * | 4/1941 | Robie | 30/2 |
| 3,407,498 | A | * | 10/1968 | Young | 30/293 |
| 4,034,473 | A | * | 7/1977 | May | 606/138 |
| 4,053,979 | A | * | 10/1977 | Tuthill et al. | 606/138 |
| 4,102,045 | A | * | 7/1978 | Bergh | 30/287 |
| 4,312,128 | A | | 1/1982 | Olsen | |
| 4,581,823 | A | * | 4/1986 | Gilman | 30/280 |
| 4,711,031 | A | * | 12/1987 | Annello | 30/294 |
| 4,852,255 | A | | 8/1989 | Hochfeld | |
| 5,007,171 | A | * | 4/1991 | Horning, Jr. | 30/294 |
| 5,016,353 | A | * | 5/1991 | Iten | 30/124 |
| 5,103,562 | A | * | 4/1992 | Braatz | 30/294 |
| D340,854 | S | | 11/1993 | Shimoharaguchi | |
| 5,673,487 | A | | 10/1997 | Malagnoux | |
| D419,417 | S | * | 1/2000 | Kane | D8/98 |
| 6,308,421 | B1 | | 10/2001 | Wang | |
| 7,073,264 | B2 | * | 7/2006 | Votolato | 30/294 |
| 2002/0073814 | A1 | | 6/2002 | Rubicam | |
| 2005/0102844 | A1 | * | 5/2005 | Addis | 30/299 |

FOREIGN PATENT DOCUMENTS

| | | |
|---|---|---|
| EP | 0629554 | 12/1994 |

* cited by examiner

*Primary Examiner*—Joseph J Hail, III
*Assistant Examiner*—Robert Scruggs

(57) ABSTRACT

A plastic package opener having a body with a generally "V" shaped configured is formed from a memory retention material, by angled first and second legs held together by a portion of material. A sharp edge or blade member is held to an interior surface of one of the legs at an angle to the terminal ends of the legs. A movable blade cover may be provided for safety. A plastic package to be opened is inserted between the open ends of the legs and the blade member brought against the plastic package by squeezing the two legs together and directed across the surface of the plastic package to sever the plastic package and open the same for removal of an item or items held therein.

4 Claims, 2 Drawing Sheets

16
22
27
26
10
28
13
20
11
24
18

29
26
10
27
15
16
12
15

PLASTIC PACKAGE OPENER

CROSS-REFERENCE TO RELATED APPLICATION

This application claims the priority of Provisional Application No. 60/710,623, entitled Plastic Package Opener, filed Aug. 23, 2005.

BACKGROUND OF INVENTION

1. Field of Invention

This invention relates generally to opening or severing apparatus and more particularly to a new and improved plastic package opener apparatus which permits reception of the conventional plastic package within the apparatus to allow severing of the plastic package as the apparatus is manually directed across each side of the plastic package.

2. Description of Related Art

Typically a consumer will use a knife, razor blade, scissors, or other type of available blade or sharpened device to open plastic packages, such as blister packs, to get at or obtain the product or products held within the plastic cover or wrapping. This can be an arduous task for almost anyone because of the difficulty in slicing or opening some plastic packages and is particularly hard for the elderly, those with poor eyesight, or those who have limited physical abilities. For them cutting open plastic packaging is difficult and sometimes impossible. Therefore, there exists the need for an improved, easy to use and safe plastic package opener.

SUMMARY OF THE INVENTION

In view of the disadvantages inherent in the known types of plastic package opening apparatus now present in the prior art, the present invention provides a plastic package opener apparatus which is easily manually manipulated and has a generally "V" shaped opening permitting the reception of a plastic package seamed edge there between; and which also permits engagement of the plastic package between the interior surfaces of the apparatus for severing of the plastic package as the apparatus is drawn across the seamed edges of the plastic package.

Therefore, it is a general purpose of the present invention is to provide a new and improved plastic package opener apparatus that has all the advantages of the prior art plastic package opening apparatus, plus other advantages and, which has none of the disadvantages.

To attain this, the present invention provides a plastic package opener having any desired shape, but which is shown for purposes of illustration only as having a generally "V" shaped configuration formed of a memory retention polymeric material, including a first leg and a second leg arranged at an angle to one another in a first position and easily movable to a position wherein they are parallel relative to one another; and wherein a blade member is mounted within an interior surface of the first leg and arranged generally at an angle to the terminal ends of the legs to receive aplastic package therethrough; and wherein the blade member is directed across the surface of a plastic package inserted between the interior surfaces of the leg members to enable aplastic package positioned there within to be easily and safely opened.

The invention resides not in anyone of the features described above, but rather in particular combinations of all of its structures for the function specified, as described more fully in the objects set forth below.

The following are some of the objects to the Invention:

To provide a new and improved plastic package opener apparatus that has all the advantages of prior art plastic package opening apparatus and none of the disadvantages.

To provide a new and improved plastic package opener apparatus that may be easily and efficiently manufactured and marketed.

To provide a new and improved plastic package opener apparatus that has low cost to manufacture with regard to material and labor and which may be delivered at a low price to the consumer.

To provide a new and improved plastic package opener apparatus that has various safety covers for the blade.

To provide a new and improved plastic package opener apparatus that has a spring back safety cover for the blade.

To provide a new and improved plastic package opener apparatus that has leverage.

To provide a new and improved plastic package opener apparatus that has ease of use To provide a new and improved plastic package opener apparatus that has an aesthetic look.

To provide a new and improved plastic package opener apparatus that has various shapes, i.e., V, S, U, O, X and A To provide a new and improved plastic package opener apparatus that is made from a memory retention material.

To provide a new and improved plastic package opener apparatus that has a durable and reliable construction To provide a new and improved plastic package opener apparatus that has a cutting blade angled generally 45 degrees to a leg.

To provide a new and improved plastic package opener apparatus that has a cutting blade angled generally 5 degrees to a leg.

To provide a new and improved plastic package opener apparatus that has a cutting blade angled generally 10 degrees to a leg.

To provide a new and improved Plastic Package opener apparatus that has a cutting blade angled generally 15 degrees to a leg.

To provide a new and improved plastic package opener apparatus that has a cutting blade angled generally 20 degrees to a leg.

To provide a new and improved plastic package opener apparatus that has a cutting blade angled generally 25 degrees to a leg.

To provide a new and improved plastic package opener apparatus that has a cutting blade angled generally 30 degrees to a leg.

To provide a new and improved plastic package opener apparatus that has a cutting blade angled generally 35 degrees to a leg.

To provide a new and improved plastic package opener apparatus that has a cutting blade angled generally 40 degrees to a leg.

To provide a new and improved plastic package opener apparatus that has a grove in an opposed surface of a leg to receive the cutting blade.

To provide a new and improved plastic package opener apparatus that has a varying degree of blade exposure.

To provide a new and improved plastic package opener apparatus that has sharpened metal edges in place of a cutting blade.

To provide a new and improved plastic package opener apparatus that has other types of sharpened material capable of cutting plastic.

To provide a new and improved plastic package opener apparatus that has a sharpened plastic edge in place of the cutting blade capable of cutting plastic.

To provide a new and improved plastic package opener apparatus that has leverage for the best angle for cutting and which may be safely operated.

BRIEF DESCRIPTION OF THE DRAWINGS

The objects and features of the present invention, which are believed to be novel, are set forth with particularity in the appended claims. The present invention, both as to organization and manner of operation, together with further objects and advantages, may best be understood by reference to the following description, taken in conjunction with the accompanying drawings, in which:

DETAILED DESCRIPTION OF THE PREFERRED EMBODIMENTS

Figure 1:
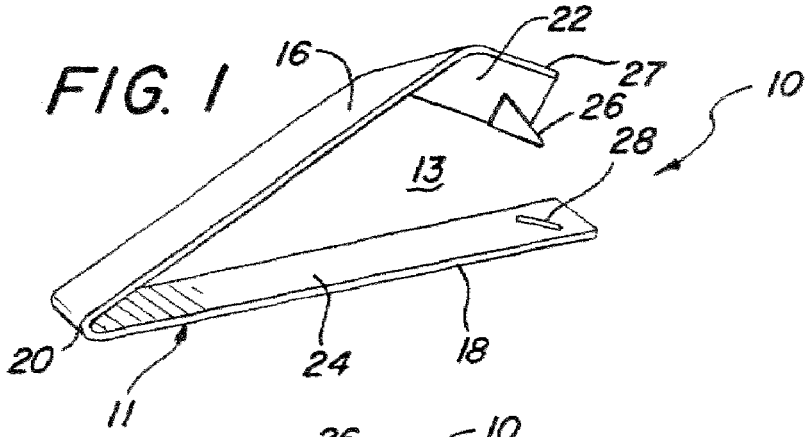
FIG. 1 is a side perspective view of a first embodiment of the plastic package opening device of the present invention.

Turning now to the drawings, and particular to FIGS. 1 and 2, a first embodiment of a new and improved plastic package opener apparatus 10 employing the principles and concepts of the present invention will now be described. More specifically, the plastic package opener apparatus 10 is used to open and essentially cooperate with a plastic package 12, by receiving the plastic package in a space 13 formed interiorly of a body 11, which may be any desired shape, but which is shown as being generally V-shaped, for purposes of illustration only and not by way of limitation. The body is formed by a pair of angled and movable legs 16, 18. During opening, a plastic package seam 15 of the plastic package 12 is positioned against an interior surface of one of the legs 16, 18 of the apparatus or device 10 and the legs pressed together to open the package 11, as described more fully below.

FIG. 1 illustrates the body 11 of the apparatus 10 as having the first leg 16 coextensive with and overlying the second leg 18. The first and second legs 16 and 18 have first and second or inner and outer ends, with the inner ends being joined by an elongated arcuate intersection 20, or any other equivalent means, such as a hinge and spring arrangement, or the like to define the V-shaped body 11. Other shaped bodies would contain a live spring or other type of attachment that would allow the first and second legs to be brought together to open a blister package and biased apart in the open or rest position.

Figure 2:
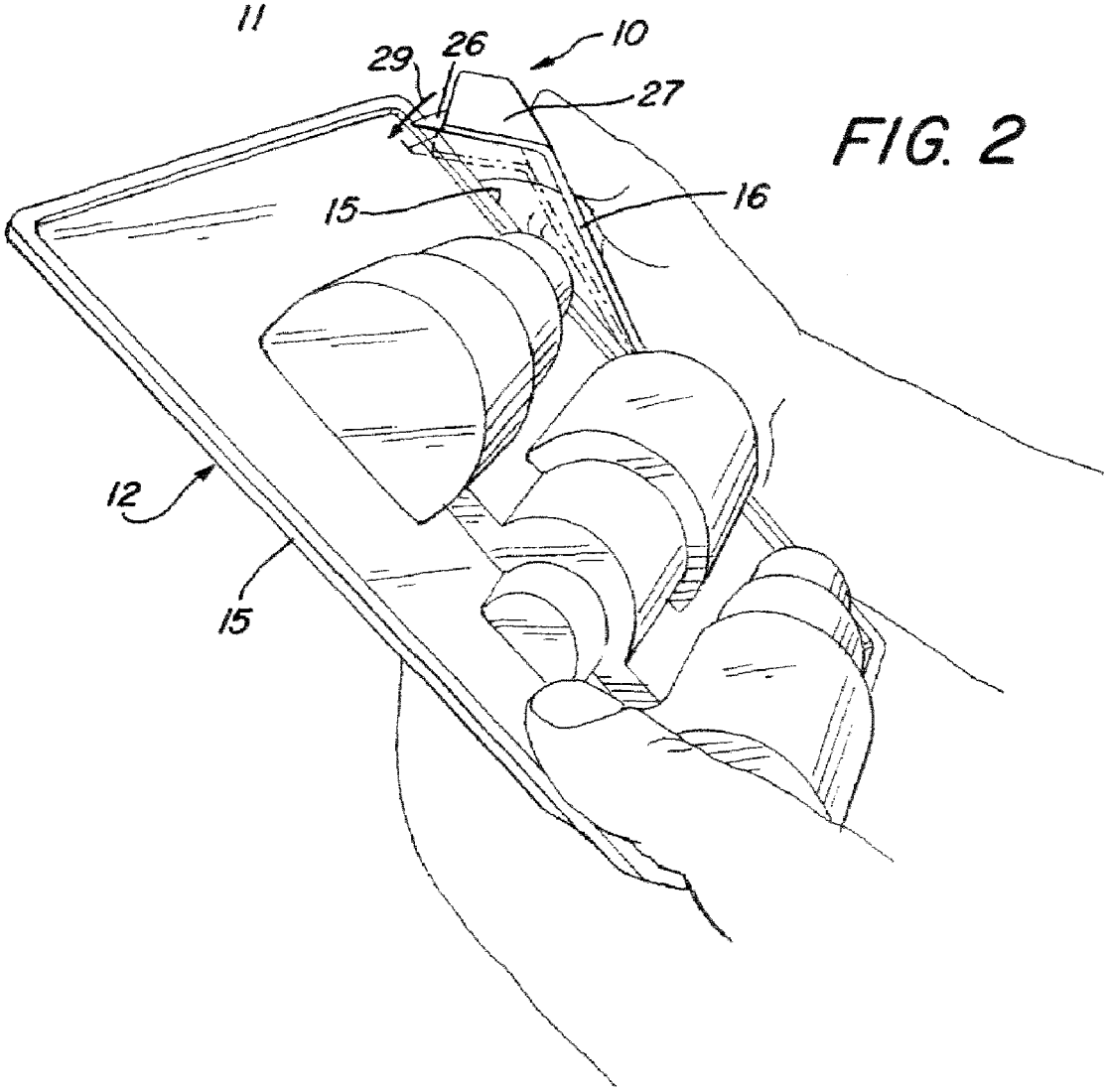
FIG. 2 is a front perspective view of a plastic package held in an opening of the first embodiment shown in FIG. 1, in a position to allow the plastic package to be easily opened.

The body 11 may be made from any desired material, but is preferably formed of a memory retentatent deformable material, such as polymeric plastic, a metal or the like to allow or effect a "spring-back" of the V-shaped body to a first or open position (non-operating) as illustrated in FIG. 1 from a second or cutting (operating) position, wherein the legs 16 and 18 are pressed or urged together, as illustrated in FIG. 2. The first and second legs 16 and 18 are pressed, squeezed or otherwise moved relative to one another from the first position of FIG. 1 to the second position shown in FIG. 2, to secure the plastic package 12 there between to allow or effect a severing operation of the plastic packaging material and thus allow the package to be opened for removal of or access to any item or items held therein.

The first leg 16 and the second leg 18 each include a respective substantially planar first and second interior surface 22 and 24 that are arranged at about a 35° angle to one another in the first or open position shown in FIG. 1.

The interior surface 22 of the first leg 16 includes a cutting edge 26, such as an integrally formed portion, a separate cutting blade, or a movably mounted cutting blade mounted on an angled or bent outer end or terminal portion 27 of the first leg, so as to be arranged at an angle to or across both the first leg 16 and the second leg 18 as well as the interior surfaces 22 and 24 of the legs. That is, the angled or bent outer end 27 of the first a lies in a plane that extends diagonally across the longitudinal axis of both the first and second legs. This allows the cutting blade or edge 26 to be placed in a confronting relationship so as to readily receive the plastic package 12 in space 13 between the legs. The angle of the outer end or terminal portion 27 of the first leg 16 and the plane in which it lies, as well as the cutting blade 26 may vary depending on the desires of the manufacturer and/or user and/or the size and shape of the device 10. Preferably, however, the selected angle is between about 5° to 45°. In one currently preferred embodiment of the invention, the angle of the bent end 27, the plane in which it lies and the cutting blade 26 is about 45°.

The cutting blade 26 readily accommodates or accomplishes a piercing and severing of an associated plastic package 12 when the blade is forced into contact with the plastic material, by squeezing the legs 16, 18 together, in the direction of the arrow 29 in FIG. 2, and then drawing or otherwise pulling or pushing the closed device 10 across or along the outside edge(s) of the plastic package. As shown in FIGS. 1 and 2, as the device 10 is drawn or otherwise moved across the plastic package 12, adjacent the seam 15, it effects a cutting of and subsequent removal of the seams on all four sides (or any other number of sides or edges a package might have) subsequent to the severing procedure.

As best shown in FIG. 1, the interior surface 24 of the second leg 18 may be provided with a grove 28 to receive the point of the cutting blade 26, to allow the cutting blade to be more easily forced through a plastic material, when the legs 16, 18 are brought or squeezed together.

Figure 3:
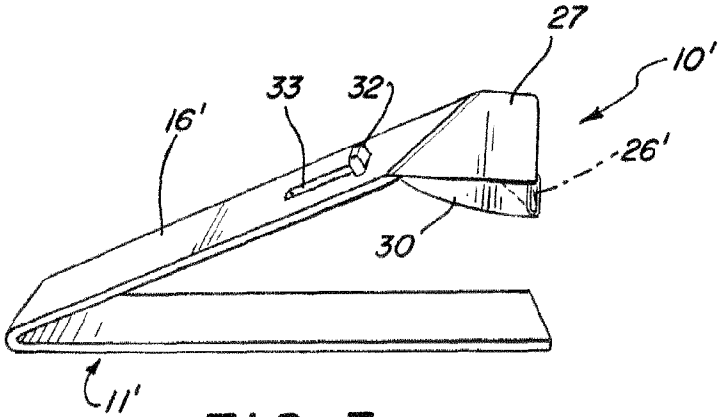
FIG. 3 is a side perspective view of a second embodiment of the plastic package opening device of the present invention having a blade cover thereon in the closed position.
Figure 4:
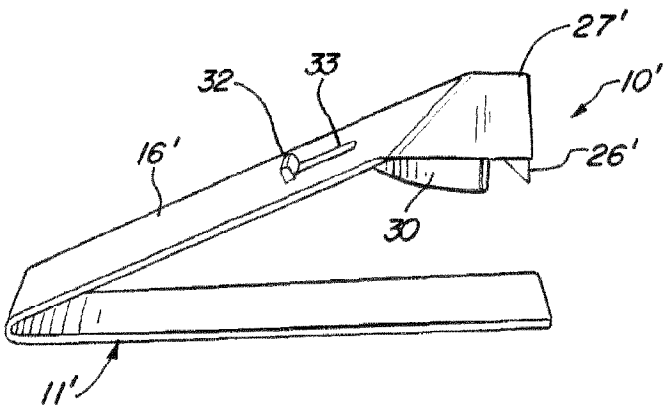
FIG. 4 shows the blade cover of the second embodiment of the plastic package opening device of FIG. 3 in the open position.

A second embodiment of the device of the present invention is shown in FIG. 3. This device 10' has a body 11' that is substantially identical to the body 11 of the first embodiment, except that the angled or bent end 27' is provided on the opposite side of the first leg 16' than 27 on leg 16. Furthermore, device 11' is provided with a safety blade guard 30 that is movable over or covers the cutting blade 26'. The safety blade guard 30 may be operated by a slide lever 32 mounted in a slot 33 formed in the first leg 16' and movable from a first to a second position to move the safety blade guard between a forward position shown in FIG. 3 where it is covering the blade 26', to a back or rear position, as shown in FIG. 4, where the cutting blade is uncovered so as to be exposed and ready to use.

Figure 5:
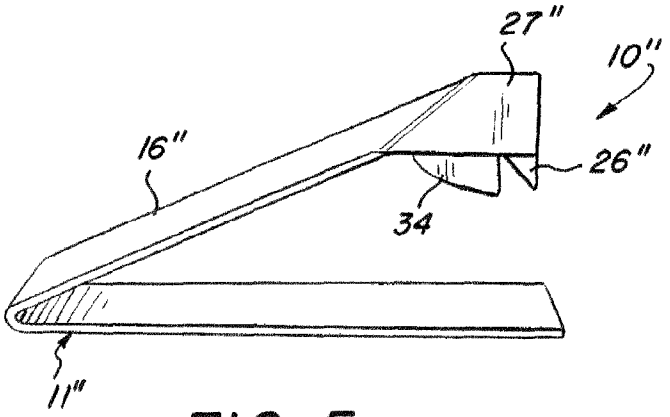
FIG. 5 is a side perspective view of a third embodiment of the plastic package opening device of the present invention having a spring biased blade cover thereon in the open position.
Figure 6:
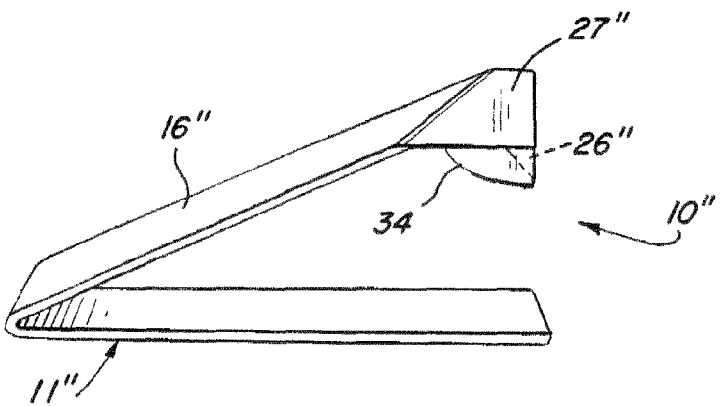
FIG. 6 shows the spring biased blade cover of the third embodiment of the plastic package opening device of FIG. 4 in the closed position.

Other types of blade guards may be provided. For example, a spring operated safety blade guard 34 is shown in an apparatus 10" shown in FIGS. 5 and 6. This apparatus 10" includes a body 11" that is substantially identical to the body 11' of the second embodiment and 11 of the first embodiment. That is, body 11'" also has an angled or bent end 27' provided on the opposite side of a first leg 16" than 27 on leg 16. Furthermore, a spring operated safety blade guard 34 is mounted on the body 11' and is moveable from a first or closed position, as shown in FIG. 6, where it covers the blade 26", to a second or opened position, as shown in FIG. 5, where it uncovers the cutting blade. The blade cover 34 is moved between the closed and opened (blade covered and uncovered) positions in a manner well known to those skilled in the art, for example, by the provision of an internal spring secured between the blade cover and the bent end 27".

Accordingly, as will be apparent to those skilled in the art, the present invention provides an improved plastic package opener apparatus or device that is easily manipulated to present a sharpened cutting edge that is capable of cutting plastic packaging material in a facile manner so as to be used by almost any person to open plastic packaging materials, as desired or needed.

Those skilled in the art will appreciate the various adaptations and modifications of the just-described preferred embodiments can be configured without departing from the scope and spirit of the invention. Therefore, it is to be understood that, within the scope of the appended claims, the invention may be practiced other than as is specifically described herein.

What is claimed is:

1. A plastic package opener comprising: a body formed from a memory retention material; the body having a first, planar leg extending along a first longitudinal axis with an inner end and an outer end, and a second leg extending along a second longitudinal axis with an inner end and outer end, with the inner end of the first leg being attached to the inner end of the second leg, the first and second leg longitudinal axes defining a plane of actuation within which the outer end of the first leg can be actuated toward the outer end of the second leg; the inner end of the first leg having a planar interior surface that is normal to the plane of actuation and faces the second leg; the first leg forming a bend along a bend line that extends obliquely across the width of the first leg and obliquely across the first longitudinal axis such that the outer end of the first leg extends toward the second leg, wherein the oblique angle of the bend line causes the outer end of the first leg to be turned into a slicing plane that is oblique to the plane of actuation; and the outer end of the first leg having a cutting edge thereon, the cutting edge lying in the slicing plane.

2. The plastic package opener of claim 1, wherein the slicing plane is at an angle of between about 5° and 45° to the plane of actuation.

3. The plastic package opener of claim 1, wherein the first longitudinal axis is at an angle of about 35° to the second longitudinal axis, and wherein the outer end extends enough toward the second leg to provide clearance around the edge of a blister pack.

4. The plastic package opener of claim 1, wherein the slicing plane is at an angle of between about 5° and 45° to the plane of actuation, and wherein the outer end extends enough toward the second leg to provide clearance around the edge of a blister pack.

* * * * *